US007699963B2

(12) United States Patent
Bayer

(10) Patent No.: US 7,699,963 B2
(45) Date of Patent: Apr. 20, 2010

(54) INTERNAL COOLING OF ELECTROLYTIC SMELTING CELL

(75) Inventor: Ingo Bayer, Richards Bay (ZA)

(73) Assignee: BHP Billiton Innovation Pty Ltd. (AU)

( * ) Notice: Subject to any disclaimer, the term of this patent is extended or adjusted under 35 U.S.C. 154(b) by 181 days.

(21) Appl. No.: 11/697,035

(22) Filed: Apr. 5, 2007

(65) Prior Publication Data

US 2007/0187230 A1 Aug. 16, 2007

Related U.S. Application Data

(63) Continuation of application No. PCT/AU2005/001617, filed on Oct. 19, 2005.

(30) Foreign Application Priority Data

Oct. 21, 2004 (AU) ..... 2004906108

(51) Int. Cl.
*C25C 7/00* (2006.01)
*C25C 3/08* (2006.01)

(52) U.S. Cl. ..... 204/247.4; 204/247.5

(58) Field of Classification Search ..... 205/396
See application file for complete search history.

(56) References Cited

U.S. PATENT DOCUMENTS

| | | | | |
|---|---|---|---|---|
| 4,481,085 | A | 11/1984 | Ishizuka | |
| 4,608,134 | A | 8/1986 | Brown | |
| 4,608,135 | A | 8/1986 | Brown | |
| 4,749,463 | A | 6/1988 | Holmen | |
| 6,811,677 | B2 | 11/2004 | Aune et al. | |
| 2004/0011661 | A1 * | 1/2004 | Bradford et al. | 205/385 |
| 2004/0149570 | A1 * | 8/2004 | Hiraiwa et al. | 204/243.1 |
| 2006/0118410 | A1 | 6/2006 | Fiot et al. | |
| 2006/0237305 | A1 | 10/2006 | Siljan | |

FOREIGN PATENT DOCUMENTS

| | | |
|---|---|---|
| AU | 74292/81 | 8/1981 |
| EP | 0 047 227 | 3/1982 |
| EP | 047 227 | 3/1982 |
| WO | WO 2005/111524 A1 | 11/2005 |
| WO | WO 2007/057534 A2 | 5/2007 |

* cited by examiner

*Primary Examiner*—Harry D Wilkins, III
(74) *Attorney, Agent, or Firm*—Brinks Hofer Gilson & Lione; G. Peter Nichols

(57) ABSTRACT

An electrolytic cell for the production of metal by electrolytic reduction of a metal bearing material dissolved in a molten salt bath, the cell including a shell, and a lining on the interior of the shell, the lining including a bottom cathode lining and a side wall lining including a plurality of fluid ducts positioned against the interior surface of the shell for conducting fluid there through, the fluid ducts extending along the sides of the shell, and communicating with pump means to flow fluid through the fluid ducts.

15 Claims, 3 Drawing Sheets

INTERNAL COOLING OF ELECTROLYTIC SMELTING CELL

This application is a continuation of and claims priority to PCT application PCT/AU2005/001617 filed on Oct. 19, 2005 published in English on May 26, 2006 as WO 2006/053372 and to Australian application no. 2004906108 filed Oct. 21, 2004, the entire contents of each are incorporated herein by reference.

FIELD OF THE INVENTION

This invention relates to an electrolytic cell for the production of aluminium and in particular, to an apparatus and method for maintaining and controlling the heat flow through the side wall of an electrolytic cell.

BACKGROUND OF THE INVENTION

Electrolytic cells for the production of aluminium comprise an electrolytic tank having a cathode and an anode generally made up of a plurality of prebaked carbon blocks. Aluminium oxide is supplied to a cryolite bath in which the aluminium oxide is dissolved. During the electrolytic processes, aluminium is produced at the cathode and forms a molten aluminium layer on the bottom of the electrolytic tank with the cryolite bath floating on the top of the aluminium layer. Oxygen is produced at the anodes causing their consumption by producing carbon monoxide and carbon dioxide gas. The operating temperature of the cryolite bath is normally in the range of 930° C. to about 970° C.

The electrolytic tank consists of an outer steel shell having carbon cathode blocks sitting on top of a layer of insulation and refractory material along the bottom of the tank. These carbon cathode blocks are connected to electrical bus bars by way of collector bars and aluminium flexibles. While the precise structure of the side walls varies, a lining comprising a combination of carbon blocks and refractory material is provided against the steel shell.

During operation of the electrolytic cell, a crust or ledge of frozen bath forms on the side walls of the electrolytic tank. While the thickness of this layer may vary during operation of the cell, the formation of this crust is critical to the operation of the cell. If the crust becomes too thick, it will affect the operation of the cell as the crust will grow on the cathode and disturb the cathodic current distribution affecting the magnetic field. On the other hand, if the frozen bath layer becomes too thin or is absent in some places, the electrolytic bath will attack the side wall lining of the electrolytic tank, ultimately resulting in failure of the side wall lining. If the attack on the side wall lining gets to the extent of the bath attacking the steel shell side walls, then the electrolytic cell has to be shut down due to the risk of metal and bath running out of the cell.

Thus controlled ledge formation is essential for good pot operation and long lifetime of the refractory lining within the cell. Furthermore, controlling the thermodynamic operation of the cell and in particular, the flow of heat from the bath through the side wall lining is essential for controlled ledge formation within the cell.

In recent technology developments, heat is removed from the cell through the steel shell of the electrolytic tank using passive heat transfer devices such as radiating fins in an attempt to increase the surface area available for heat transfer from the side walls of the electrolytic tank. The heat needing to be removed from the electrolytic cell is dependent upon the amount of current passing through the cell and the cell voltage. If there is an increase in the current or voltage, then the heat which needs to be extracted through the side wall to maintain an appropriate thickness of ledge formed on the inner wall of the refractory material will increase and can often vary beyond the design capabilities of the passive cooling elements on the side of the electrolytic cell.

Accordingly, it is an object of the present invention to provide a means by which the thermodynamic requirements of an electrolytic cell can be actively controlled to enable the formation and maintenance of a ledge on the inner surface of the side wall refractory material.

SUMMARY OF THE INVENTION

According to one aspect of the invention, there is provided an electrolytic cell for the production of metal by electrolytic reduction of a metal bearing material (e.g. aluminium oxide called alumina) dissolved in a molten salt bath, the cell including a shell, and a lining on the interior of the shell, the lining including a bottom cathode lining and a side wall lining including a plurality of fluid ducts positioned against the interior surface of the shell for conducting fluid there through, the fluid ducts extending along the sides of the shell, and communicating with pump means to flow fluid through the fluid ducts.

In the context of the invention, the side walls of the cell are the longitudinal side walls and end walls of the cell.

The applicant has found that by providing fluid ducts adjacent the inside shell surface, heat can be extracted from the cell at a sufficient rate to maintain the ledge of frozen bath material at a sufficient thickness to protect the side wall refractories. During operation of an electrolytic cell, the magnetic fields induced by the electric current cause movement of the molten metal within the cell. This movement of molten metal creates hotter regions within the cell, thereby increasing the heat transfer requirement in that region to maintain a sufficient thickness of frozen bath material against the cell side walls. These molten metal currents may also lead to erosion of the frozen bath ridge and thus expose the refractory side wall, unless sufficient heat is removed from the cell in that region to maintain the thickness of the frozen ledge.

Therefore, in one preferred form of the invention, the cell is provided with at least two banks of cooling fluid ducts along each longitudinal side of the shell, each bank of cooling fluid ducts cooling a fixed proportion of the cell. In one preferred form of the invention, each bank of cooling ducts extracts heat from approximately one half of each longitudinal side of the cell. Each bank of cooling ducts also extends along at least a portion of an end wall and joining the respective longitudinal side.

The cooling fluid ducts discussed above are able to carry any fluid capable of transferring the heat conducted through the refractory. While coolant liquids provide scope for greater heat conduction away from the cell, they also represent an increase in the associated risk of using a liquid in proximity to molten metal and the cost of handling systems for the liquid. Hence, it is preferable that the cooling fluid passing through the fluid ducts is a gas and preferably air. The pump means used to flow cooling fluid into the cooling ducts may be an air blower or other type of gas pump. In the case of a fluid, any commonly available liquid pump may be used.

The direction of the molten metal currents within the cell is determined by the design of the electrical busbars and the induced magnetic field. On the downstream side of the cell, the molten metal is usually directed towards the middle of the longitudinal side. This causes the centre of the downstream longitudinal side to be hotter than the outer ends.

Accordingly, it is preferable that the cooling fluid entering the cooling fluid ducts on the downstream side enters via inlets substantially on or adjacent the centre region of the cell, which corresponds to the short axis of the cell and exits through outlets adjacent the respective ends of the cell.

On the upstream side of the cell, the induced currents in the molten metal deliver molten metal away from the centre region of the cell. Accordingly, on the upstream side of the cell, the cooling fluid enters the cooling fluid ducts at inlets positioned adjacent the respective ends of the cell and exits the fluid ducts at outlets substantially on or adjacent the centre region of the longitudinal side of the cell.

In a preferred form of the invention, air heated after passing through the fluid ducts can be heat exchanged with the alumina or with fluidising gas transporting alumina to the electrolytic cell.

BRIEF DESCRIPTION OF THE DRAWINGS

Embodiments of the invention will be described, by way of example, with reference to the accompanying drawings.

FIG. 1(*b*) is a perspective view of the side wall lining and cooling in the embodiment of FIG. 1(*a*).

FIG. 1(*c*) is a perspective view of the internal fluid ducts of the embodiment of FIGS. 1(*a*) and 1(*b*).

DETAILED DESCRIPTION OF THE EMBODIMENTS

It will be understood that the invention disclosed and defined in this specification extends to all alternative combinations of two or more of the individual features mentioned or evident from the text or drawings. All of these different combinations constitute various alternative aspects of the invention.

Figure 1B:
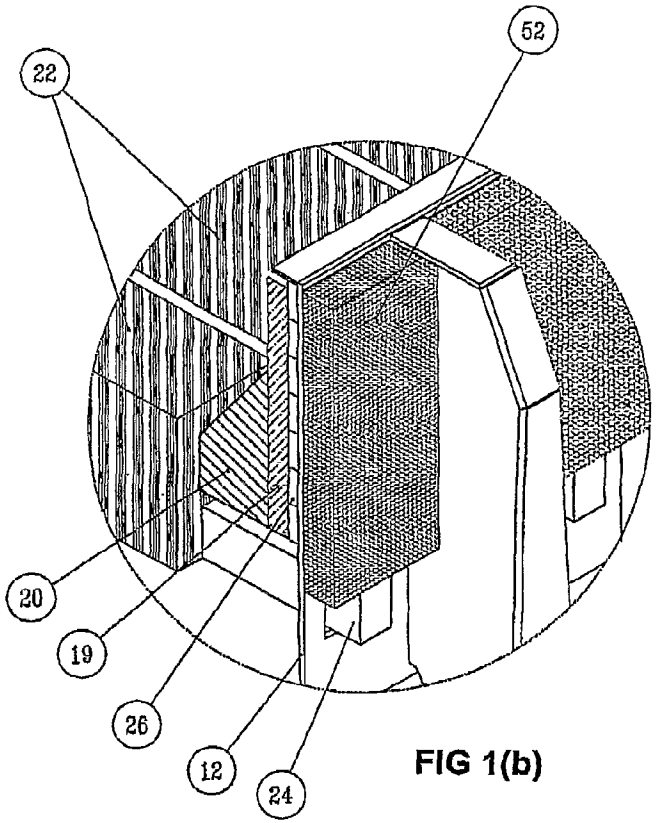
FIG. 1(*a*) is a sectional view of an embodiment of a shell in accordance with the invention.
Figure 1A:
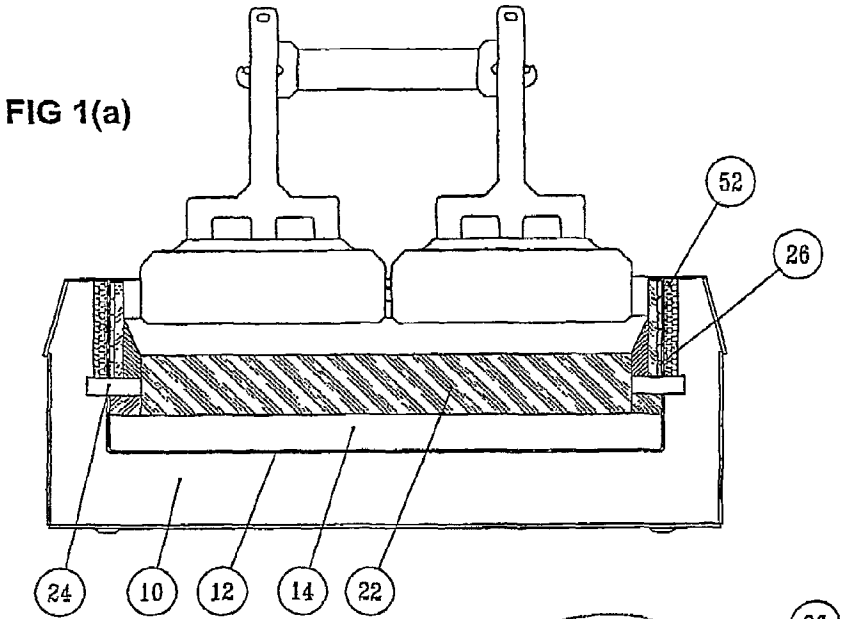
Figure 1C:
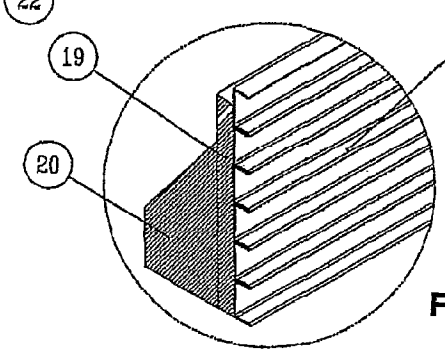

In the sectional view of an electrolytic pot shown in FIG. 1, the electrolytic cell comprises a multitude of steel cradles 10 and a steel shell 12 as well as an internal refractory lining comprising a bottom insulating layer 14 and a sidewall lining 19 and 20. Suitably the lining consists of a material, which has the ability to resist corrosive attacks from the electrolyte and the molten aluminium as well as having reasonably good properties with respect to thermal and electrical conductivity. The side lining comprises a number of blocks, which are formed from materials such as silicon carbide 19 and carbonaceous materials 20. Resting on the bottom insulation is a cathode 22 connected to a collector bar 24, which directs current away from the cathode.

Figure 2:
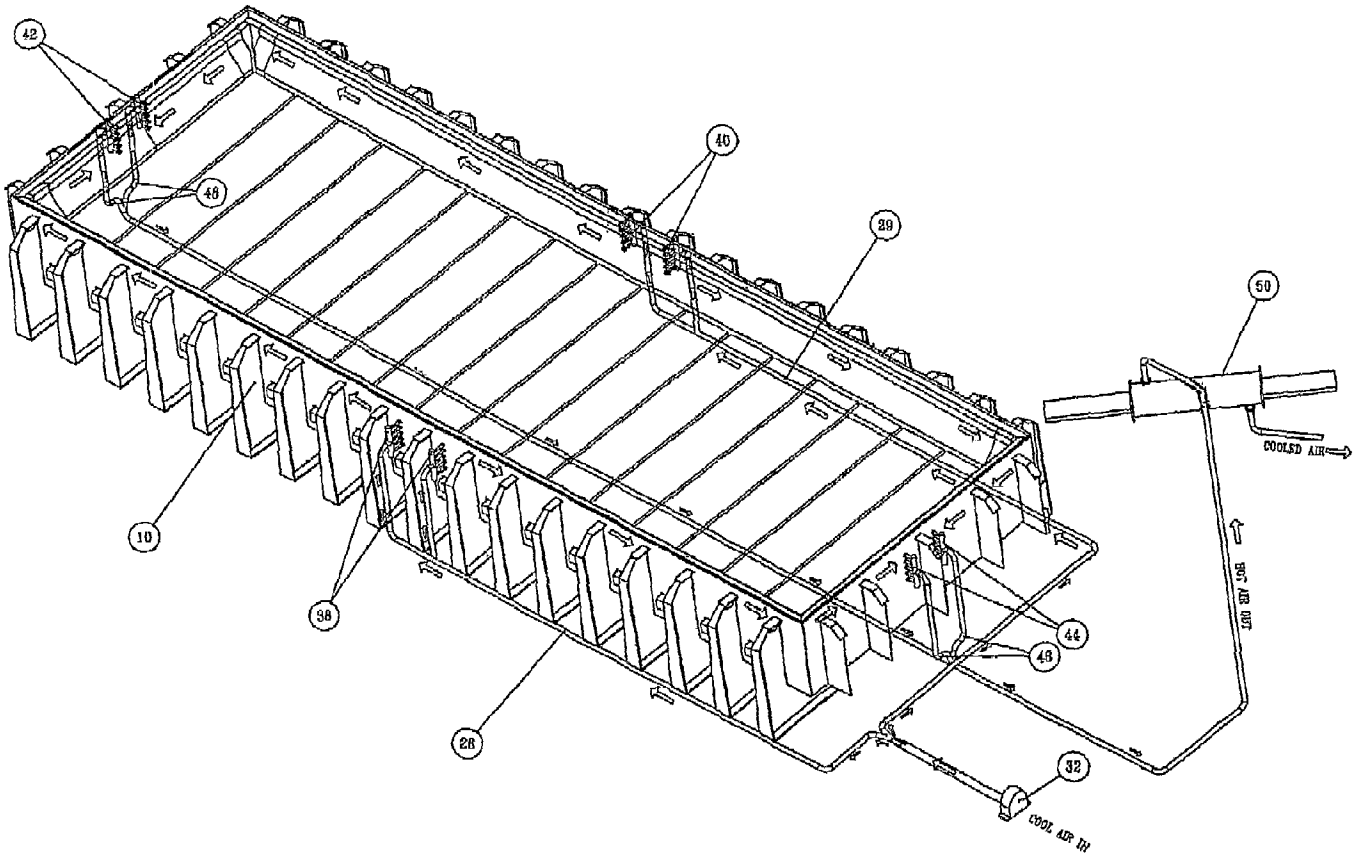
FIG. 2 is a schematic view of a possible flow direction of fluid through the fluid ducts on the upstream and downstream side of a cell.

In the embodiment shown in FIG. 1(*b*) and 1(*c*), internal fluid ducts 26 are provided extending horizontally along the side wall of the electrolytic cell. A paste of thermally conducting material is provided between block 19 and fluid ducts 26 to provide good thermal contact between the fluid ducts and the sidewall block 19. Fluid ducts 26 are provided with fluid pipes 28, 29 and 48, which convey fluid to and from the fluid ducts 26 as shown in FIG. 2. This fluid may be either liquid or gas. While liquids may be attractive from a heat conduction view point, the introduction of liquid into a high temperature environment does represent a substantial increase in safety risk and increases the likelihood of liquids explosively coming into contact with liquid metal. Furthermore, liquids will pose an electrical hazard, as the electrolytic cell potentials will be difficult to remain separated. Thus while there may be some benefits in using liquids, a readily available gas such as air is preferred.

When operating an electrolytic cell, the internal fluid ducts may be set to operate such that the temperature of the side-lining surface 19 and 20 facing the interior of the electrolytic cell are slightly below the temperature of the molten electrolytic bath. Thus due to the temperature difference created by the cooling effect of the fluid flowing through the internal fluid ducts 26 and the molten electrolytic bath, a solid stable ledge forms on the interior of the side lining. This ledge assists in protecting the side lining from the molten electrolytic bath and greatly increases the life of the side lining.

FIG. 2 discloses an air pump 32 supplying inlet fluid pipes 28 and 29. These pipes supply inlet manifolds 38 and 40 which are in fluid communication with the internal fluid ducts 26, within the side lining of the cell on the inside of the pot shell 12. The inlet manifolds 38, 40 are arranged towards the middle of the longitudinal side at approximately the short axis of the cell and direct the fluid entering the fluid ducts towards the respective ends of the cell. The fluid passes around a section of the side lining and is collected at outlet manifolds 42 and 44 in the ends of the cell. Manifolds 42 and 44 communicate with respective outlet fluid pipes 48, which are joined together and are passed to a heat exchanger 50. In the heat exchanger, the heated outlet air transfers heat to a suitable medium such as fluidising air to the transport of alumina feed for the electrolytic cell. This transferred heat heats the feed alumina prior to addition to the cell. In the arrangement shown in FIG. 2, inlet manifolds 38, 40 are shown directing cooling fluid to the centre of the electrolytic cell and the fluid then passes through the internal fluid ducts and exits at the respective ends of the cell through outlet manifolds 42, 44.

Figure 3:
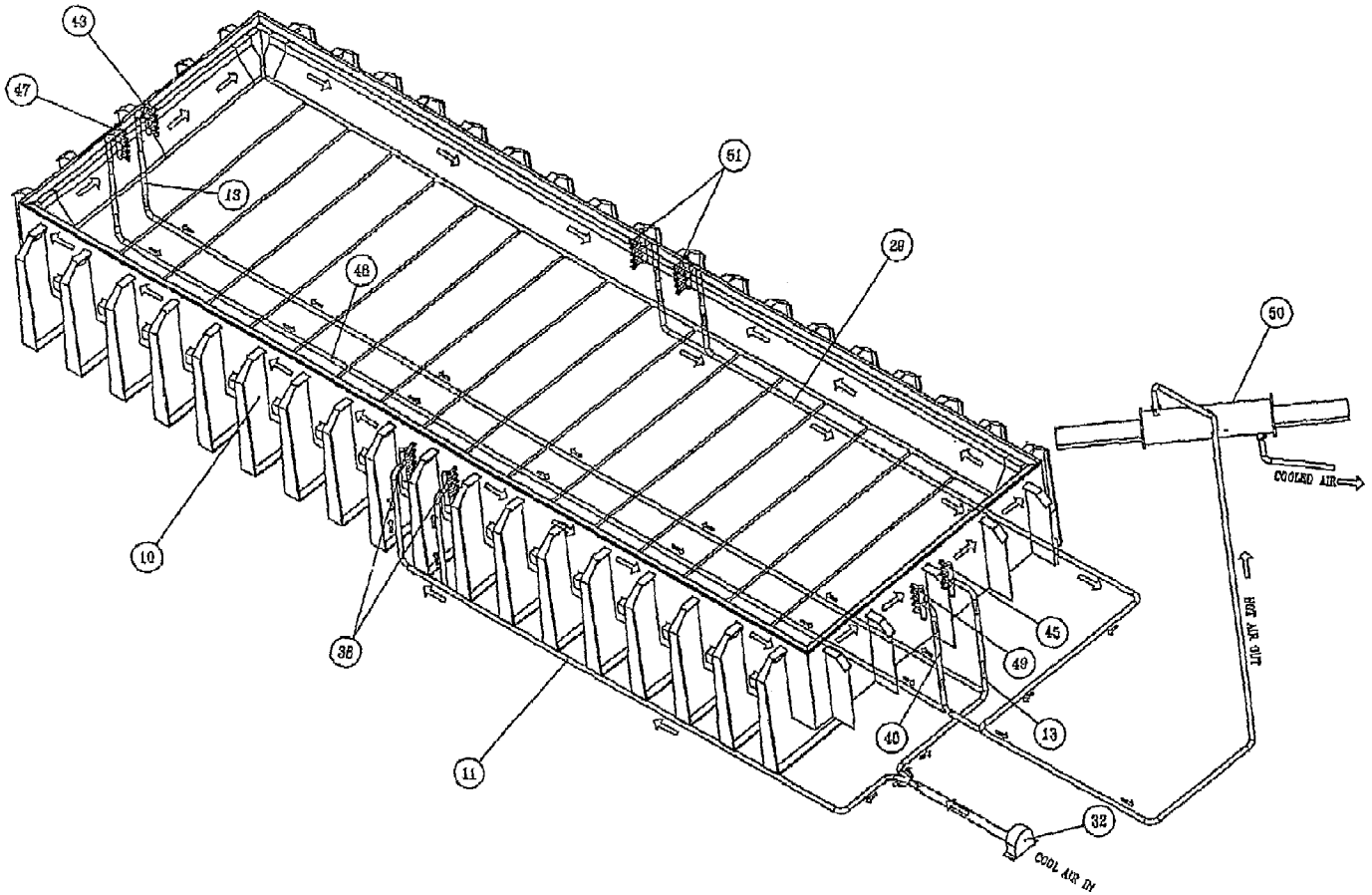
FIG. 3 is a schematic view of a possible flow direction of fluid through the fluid ducts on the upstream and downstream side of a cell.

In the alternative fluid paths shown in FIG. 3, the fluid cooling the upstream side of the cell is supplied by inlet pipes 11 and 13 and enters through inlet manifolds arranged at the cell ends (43, 45) which direct the fluid towards outlet manifolds 51 at the centre region of the cell upstream side. This centre region approximates the position of the short axis of the cell. In the embodiment of FIG. 3, the downstream side of the cell has inlet manifolds at or about the centre region (38) of the cell which directs fluid through the internal fluid ducts to the outlet manifolds at respective ends of the cell (47, 49). The hot air from the outlet manifolds 47, 49 and 51 is directed to the heat exchanger 51 through the outlet fluid pipes 48.

While the invention has been illustrated with respect to a small number of fluid ducts 26 and inlets 38, 40, 43 and 45 it would be appreciated by those skilled in the art that any number of fluid ducts and inlets could be used with their cross sections and positions along the side wall varied in order to accommodate the expected hot regions along the side wall. To achieve optimum heat removal the application of the internal fluid ducts should not be limited to the long sides of the cell but can also be implemented on the short sides of the cell. It would also be possible to position the internal fluid ducts in a vertical rather than horizontal direction.

It would also be appreciated by those skilled in the art that by monitoring the temperature of the gas, as it enters and leaves the fluid ducts 26, an indication of the heat removed from the cell can be determined and the amount of heat removed correlated to the thickness of the formed ridge. It would also be appreciated that by continuing to monitor the increase in fluid temperature between the inlet and outlet, an indication as to potential problems relating to the thickness of the cell lining and the health of the ledge can be determined. The fluid temperature and its trends can be used as a process variable to adjust the volume of the fluid in the ducts by increasing or lowering the speed of the air pump or alternatively by controlling the fluid flow volume through a series of dampers in the pipe system.

Since all of the heat being removed through the side wall is predominantly through the fluid conduits, less heat radiates from the outer surface of the pot shell 12. This provides opportunities to further control the heat balance out of the pot by providing insulation to the outside of the pot shell.

During the operation of electrolytic cells, there are occasions when the power supply to the cells is disrupted temporarily. In order to prevent the contents of the cells from solidifying during these power disruptions, the pot shell may be provided with a layer of insulation 52 which may be positioned against the outer surface of the pot shell in order to retain the heat within the cell with the flow of the fluid being stopped during the power supply disruption. Since the heat through the side wall lining is predominately removed through the fluid ducts 26, this insulation may form a permanent fixture on the pot shell wall.

Many modifications may be made to the present invention described above without departing from the spirit and scope of the invention.

The invention claimed is:

1. An electrolytic cell for the production of metal by electrolytic reduction of a metal bearing material dissolved in a molten salt bath, the cell including a shell, and a lining on the interior of the shell, the lining including a bottom cathode lining and a side wall lining including a plurality of fluid ducts positioned against the interior surface of the shell for conducting fluid therethrough, each fluid duct extending along a substantial portion of at least one of a longitudinal or end side of the shell, and communicating with a pump to flow fluid through the fluid ducts.

2. The electrolytic cell of claim 1 wherein the fluid ducts are provided with an inlet and an outlet.

3. The electrolytic cell of claim 2 wherein the inlet is provided at a hotter region of the electrolytic cell than the outlet.

4. The electrolytic cell of claim 2 wherein the fluid from the outlet of the fluid duct is passed to a heat exchanger for heat exchange with metal bearing material feed for the cell.

5. The electrolytic cell of claim 1 wherein the fluid ducts are arranged in at least two banks of ducts along each longitudinal side of the cell.

6. The electrolytic cell of claim 5 wherein each bank of ducts extends along a portion of an end adjoining the respective longitudinal side.

7. The electrolytic cell of claim 5 wherein each bank of ducts includes more than one fluid duct.

8. The electrolytic cell of claim 1 wherein the cell is one cell in a cell pot line, the cell having an upstream side and a downstream side relative to the overall flow of current in the cell pot line.

9. The electrolytic cell of claim 8 wherein the fluid ducts are provided with at least one inlet and at least one outlet, with an inlet for the fluid ducts on the downstream longitudinal side being provided substantially on or adjacent a center region of the cell, and an outlet being provided on or adjacent the respective end of the cell.

10. The electrolytic cell of claim 9 wherein the ducts are provided with at least one inlet and at least one outlet, with an inlet for the ducts on the upstream longitudinal side being provided on or adjacent the respective ends of the cell, and an outlet being provided on or adjacent a center region of the upstream longitudinal side of the cell.

11. The electrolytic cell of claim 1 wherein each fluid duct is arranged parallel to the bottom cathode lining.

12. The electrolytic cell of claim 1 wherein at least one fluid duct extends along at least one of the longitudinal sides from a location near one end side to a location near another end side.

13. The electrolytic cell of claim 12 wherein at least one fluid duct extends along each longitudinal side from a location near one end side to a location near another end side.

14. The electrolytic cell of claim 12 further comprising at least one fluid duct that extends along one end side.

15. The electrolytic cell of claim 12 further comprising at least one fluid duct that extends along one end side from a location near one longitudinal side to a location near another longitudinal side.

* * * * *